US006765547B2

(12) United States Patent
Lee

(10) Patent No.: US 6,765,547 B2
(45) Date of Patent: Jul. 20, 2004

(54) METHOD OF DRIVING A PLASMA DISPLAY PANEL, AND A PLASMA DISPLAY APPARATUS USING THE METHOD

(75) Inventor: Joo-yul Lee, Asen (KR)

(73) Assignee: Samsung SDI Co., Ltd., Suwon (KR)

( * ) Notice: Subject to any disclaimer, the term of this patent is extended or adjusted under 35 U.S.C. 154(b) by 376 days.

(21) Appl. No.: 09/961,175

(22) Filed: Sep. 24, 2001

(65) Prior Publication Data

US 2002/0044107 A1 Apr. 18, 2002

(30) Foreign Application Priority Data

Oct. 13, 2000 (KR) ..... 2000-60257

(51) Int. Cl.[7] ..... G09G 3/28
(52) U.S. Cl. ..... 345/60; 345/62
(58) Field of Search ..... 345/60, 62, 63; 315/169.1, 169.2, 169.3, 169.4

(56) References Cited

U.S. PATENT DOCUMENTS

| | | | | |
|---|---|---|---|---|
| 4,044,349 A | | 8/1977 | Andoh et al. | 340/324 |
| 4,562,434 A | | 12/1985 | Amano | 340/775 |
| 4,629,942 A | | 12/1986 | Horio et al. | 315/169.4 |
| 4,638,218 A | | 1/1987 | Shinoda et al. | 315/169.4 |
| 4,737,687 A | | 4/1988 | Shinoda et al. | 315/169.4 |
| 5,030,888 A | | 7/1991 | Salavin et al. | 315/169.4 |
| 5,995,069 A | | 11/1999 | Tokunaga et al. | 345/60 |
| 6,087,779 A | * | 7/2000 | Sakamoto et al. | 315/169.1 |
| 6,278,420 B1 | * | 8/2001 | Mikoshiba et al. | 345/60 |
| 6,288,691 B1 | * | 9/2001 | Mikoshiba et al. | 345/60 |
| 6,326,736 B1 | * | 12/2001 | Kang et al. | 315/169.4 |
| 6,473,061 B1 | * | 10/2002 | Lim et al. | 345/60 |
| 6,492,964 B1 | * | 12/2002 | Mikoshiba et al. | 345/60 |
| 6,525,703 B1 | * | 2/2003 | Salavin et al. | 345/68 |
| 6,559,814 B1 | * | 5/2003 | Kanazawa et al. | 345/60 |
| 6,597,331 B1 | * | 7/2003 | Kim | 345/60 |
| 6,600,463 B2 | * | 7/2003 | Kim | 345/60 |
| 6,628,250 B1 | * | 9/2003 | Yoo et al. | 345/60 |
| 6,628,251 B1 | * | 9/2003 | Ishizuka | 345/60 |

FOREIGN PATENT DOCUMENTS

| | | |
|---|---|---|
| JP | 10-333637 | 12/1998 |
| KR | 1998-086932 | 12/1998 |

OTHER PUBLICATIONS

U.S. patent application Ser. No. 09/081,827, Mikoshiba et al., filed May 20, 1998.

* cited by examiner

*Primary Examiner*—Vijay Shankar
*Assistant Examiner*—Nitin Patel
(74) *Attorney, Agent, or Firm*—McGuireWoods LLP

(57) ABSTRACT

A method of driving a plasma display panel including erasing wall charges formed in a previous sub-field, applying X and Y scan pulses of first and second polarities to the X and Y electrode lines of a first pair of the X and Y groups that includes a first pair of the X and Y electrode lines, and an X scan pulse of a second polarity to form wall charges of the second polarity around the Y electrode lines, applying a display data signal corresponding to the first pair of the X and Y electrode lines to address electrode lines while applying a bias voltage of the first and second polarities to the X and Y electrode lines to erase the wall charges formed at discharge cells which are not to be displayed, and repeatedly applying sustain pulses to the X and Y electrode lines.

24 Claims, 9 Drawing Sheets

A12
SF1
A1
S1
A11
A13
A14

SAR1,...,ABn
22a
22b

SX1,...,X480
23
25

SY1
24

SY2
24

SY480
24
VOLTAGE
TIME

SF1
R1
A1
S1

$S_{XX1}$
GND
$-V_x$
200

$S_{XX2}$ $S_{XX3}$ $S_{XX4}$ $S_{YY1}$
GND $S_{YY2}$
300
$+V_y$ $S_{YY3}$ $S_{YY4}$
$V_a$
400

$S_{AR1,...,AB5}$
GND
t1
t2
t3
t4

SF1
R1
A1
S1
520
210
620

SXX1
GND
220

SXX2

SXX3

SXX4

SYY1
320
GND

SYY2
310

SYY3
530

SYY4
510
610 630
400

SAR1,...,AB5
GND
t1 t2 t3 t4

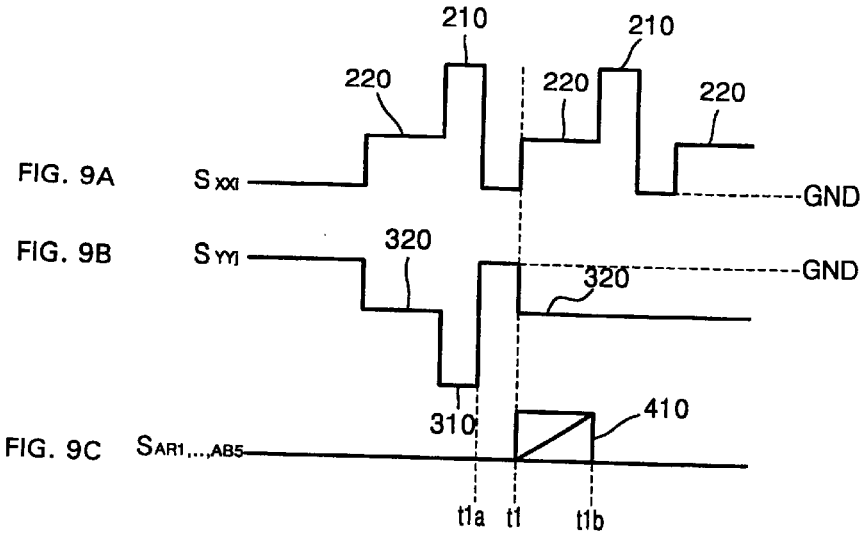
FIG. 9A
FIG. 9B
FIG. 9C
$S_{XXI}$
$S_{YYI}$
$S_{AR1,...,AB5}$
210
220
320
310
410
GND
t1a
t1
t1b
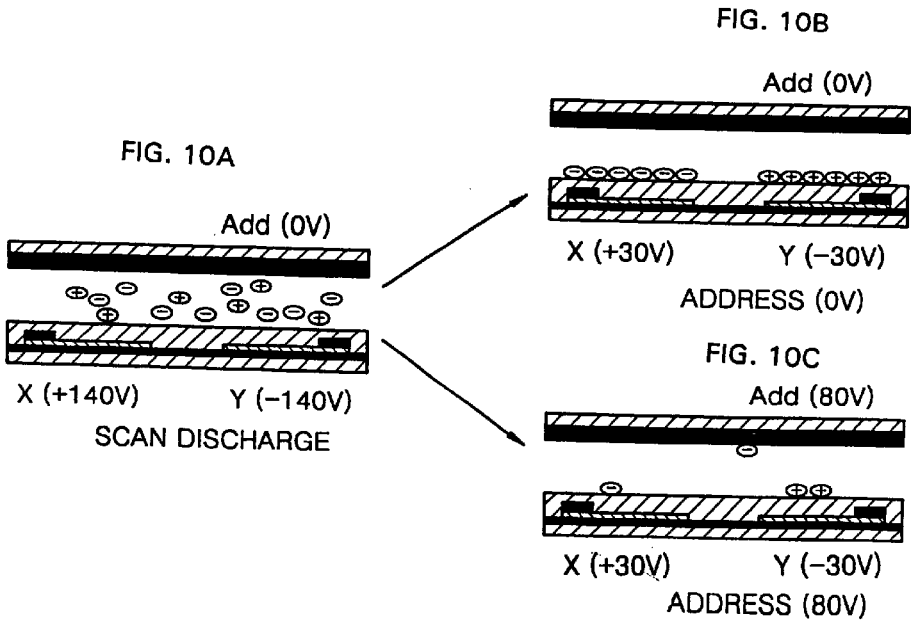
FIG. 10A
Add (0V)
X (+140V)
Y (−140V)
SCAN DISCHARGE
FIG. 10B
Add (0V)
X (+30V)
Y (−30V)
ADDRESS (0V)
FIG. 10C
Add (80V)
X (+30V)
Y (−30V)
ADDRESS (80V)

METHOD OF DRIVING A PLASMA DISPLAY PANEL, AND A PLASMA DISPLAY APPARATUS USING THE METHOD

CROSS-REFERENCE TO RELATED APPLICATIONS

This application claims the benefit of Korean Application No. 2000-60257, filed Oct. 13, 2000, in the Korean Industrial Property Office, the disclosure of which is incorporated herein by reference.

BACKGROUND OF THE INVENTION

1. Field of the Invention

The present invention relates to a method of driving a plasma display panel, and more particularly, to a method of driving an alternating current (AC) type triode surface-discharge plasma display panel by applying an AND logic driving method to an address-display separation driving method.

2. Description of the Related Art

The structures of plasma display panels are largely classified into a counter-discharge structure and a surface-discharge structure depending on the arrangement of discharging electrodes. In addition, methods of driving a plasma display panel are classified into a direct current (DC) driving method and an AC driving method depending on whether the polarity of a driving voltage changes or not.

Referring to FIGS. 1A and 1B, discharge spaces 16 are formed between front glass substrates 10 and 1, and rear-glass substrates 20 and 2 in a plasma display panel of DC type counter-discharge structure and a plasma display panel of AC type surface-discharge structure, respectively. Referring to FIG. 1A, in the DC type plasma display panel, a scan electrode 18 and an address electrode 11 are directly exposed to the discharge space 16. Referring to FIG. 1B, in the AC type plasma display panel, display electrodes 3 to perform display are disposed within a dielectric layer 5 so that the display electrodes 3 are electrically separated from the discharge space 16. Here, display is performed by a well-known wall-charge effect. For example, in discharge cells where discharge is provoked between an address electrode 8 and a scan electrode 3*a*, wall charges are formed around the address electrode 8 and the scan electrode 3*a*. Thereafter, a voltage lower than a discharge triggering voltage is applied between the line of the scan electrode 3*a* and the line of a common electrode 3*b* so that display can be performed only in discharge cells where wall charges are formed around the scan electrode 3*a*. Reference numeral 5' denotes a dielectric layer covering the address electrode 8.

Referring to FIG. 2, the address electrode lines 8, the dielectric layers 5 and 5', the X-Y electrode lines 3, barriers 6 and a magnesium monoxide (MgO) layer 9 as a protective layer are provided between the front glass substrate 1 and the rear glass substrate 2 in a conventional AC type triode surface-discharge plasma display panel. Reference numeral 4 denotes a metal electrode line to increase the conductivity of each X-Y electrode line 3. Each X-Y electrode line 3 includes a scan electrode 3*a* and a common electrode 3*b* as shown in FIG. 1B.

The parallel address electrode lines 8 are formed on a top surface of the rear glass substrate 2. The rear dielectric layer 5' is deposited on the entire surface of the rear glass substrate 2 having the address electrode lines 8. The barriers 6 are formed on the surface of the rear dielectric layer 5' such that the barriers 6 are parallel to the address electrode lines 8. The barriers 6 define the discharge areas of discharge cells and prevent optical crosstalk between adjacent discharge cells. A phosphor layer 7 is formed between adjacent pairs of the barriers 6. The phosphor layer 7 generates light having a color (red, green, or blue) corresponding to ultraviolet rays generated due to the discharge of each discharge cell.

The X-Y electrode lines 3 are formed on a bottom surface of the front glass substrate 1 in a direction perpendicular to a direction of the address electrode lines 8. The discharge cells are defined at intersections of the X-Y electrode lines 3 and the address electrode lines 8. The front dielectric layer 5 is deposited on the entire bottom surface of the front glass substrate 1 having the X-Y electrode lines 3. The MgO layer 9, which protects a display panel from an intensive electric field, is deposited on the entire surface of the front dielectric layer 5. Gas (not shown) used to form a plasma is sealed in the discharge space 16.

FIG. 3 illustrates a typical address-display separation driving method for the AC type triode surface-discharge plasma display panel of FIG. 2. FIG. 4 illustrates the interactions between the X-Y electrode lines 3 and the address electrode lines 8 used to perform in the driving method of FIG. 3 in the plasma display panel of FIG. 2. Referring to FIGS. 3 and 4, a unit frame (i.e., a unit television field) is divided into 6 sub-fields SF1 through SF6 to realize time division gray-scale display. In addition, each of the sub-fields SF1 through SF6 is divided into corresponding address periods A1 through A6 and sustain periods S1 through S6. During each of the address periods A1 through A6, a display data signal is applied to address electrode lines $A_{R1}, \ldots, A_{B5}$, and simultaneously, corresponding scan pulses are sequentially applied to Y electrode lines Y1 through Y16. Accordingly, when the display data signal of a high level is applied while scan pulses are being applied, wall charges are formed in the corresponding discharge cells due to the address discharge. In the discharge cells other than the corresponding discharge cells, wall charges are not formed.

During each of the sustain periods S1 through S6, a display pulse is alternately applied to all the Y electrode lines Y1 through Y16 and all the X electrode lines X1 through X16 so that a display is performed in the discharge cells having the wall charges. Therefore, the luminance of a plasma display panel is proportional to the time of the sustain periods S1 through S6 in a unit television field.

Here, the sustain period S1 of the first sub-field SF1 is set to a time 1T corresponding to $2^0$. The sustain period S2 of the second sub-field SF2 is set to a time 2T corresponding to $2^1$. The sustain period S3 of the third sub-field SF3 is set to a time 4T corresponding to $2^2$. The The sustain period S4 of the fourth sub-field SF4 is set to a time 8T corresponding to $2^3$. The sustain period S5 of the fifth sub-field SF5 is set to a time 16T corresponding to $2^4$. The sustain period S6 of the sixth sub-field SF6 is set to a time 32T corresponding to $2^5$. Consequently, among the 6 sub-fields SF1 through SF6, a sub-field to be displayed can be appropriately selected so that gray-scale display can be performed.

FIGS. 5A through 5E illustrate the driving signals in the unit sub-field SF1 according to the address-display separation driving method of FIG. 3. Here, it is assumed that a plasma display panel to which the driving method of FIG. 5 is applied has n red (R) address electrode lines, n green (G) address electrode lines, n blue (B) address electrode lines, and 480 pairs of the X and Y electrode lines. In FIGS. 5A through 5E, reference character $S_{AR1, \ldots, ABn}$ denotes a driving signal applied to the address electrode lines $A_{R1}$, $A_{G1}, \ldots, A_{Gn}, A_{Bn}$, reference character $S_{X1, \ldots, X480}$ denotes a driving signal applied to the corresponding X electrode lines X1 through X480, and reference character $S_{Y1, \ldots, Y480}$ denotes a driving signal applied to the corresponding Y electrode lines Y1 through Y480. Referring to FIGS. 5A through 5E, the address period A1 in the unit sub-field SF1 is divided into reset periods A11, A12 and A13 and a main address period A14.

During the sustain period S1, a display pulse 25 is alternately applied to all the Y electrode lines Y1 through Y480 and all the X electrode lines X1 through X480 so that the display is performed in the discharge cells having the wall charges formed during the corresponding address period A1. When a final pulse is applied to the X electrode lines X1 through X480 during the sustain period S1, electrons are formed around X electrodes of the selected discharge cells for display, and positive charges are formed around the Y electrodes thereof. Accordingly, during the first reset period of the next subfield, a pulse 22*a* having a lower voltage and larger width than the display pulse 25 is applied to the X electrode lines X1 through X480 to perform a discharge to primarily remove the wall charges. In addition, during the second reset period A12, a pulse 23 having the same voltage as and a smaller width than the display pulse 25 is applied to all the Y electrode lines Y1 through Y480 so that discharging for secondarily removing the remaining wall charges is performed. During the third reset period A13, a pulse 22*b* having a lower voltage and a larger width than the display pulse 25 is applied to the X electrode lines X1 through X480 to perform a discharge to finally remove the wall charges. Consequently, all the wall charges can be removed from the discharge space, and space charges can be uniformly distributed during reset periods A11, A12, and A13.

During the main address period A14, a display data signal is applied to the address electrode lines $A_{R1}, A_{G1}, \ldots, A_{Gn}$, $A_{Bn}$, and simultaneously, a scan pulse 24 is sequentially applied to the Y electrode lines Y1 through Y480. For the display data signal applied to each of the address electrode lines $A_{R1}, A_{G1}, \ldots, A_{Gn}, A_{Bn}$, a positive polarity voltage Va is applied when selecting a discharge cell, bul. otherwise, a ground voltage (i.e., 0 V) is applied. A bias voltage of a positive polarity is applied to the Y electrode lines Y1 through Y480 while a scan is not performed, and the scan pulse 24 of 0 V is applied thereto while a scan is being performed. Accordingly, when the display data signal is applied while the scan pulse 24 of 0 V is being applied, wall charges are formed in the corresponding discharge cells due to address discharge, but are not formed in the other discharge cells. Here, to realize more accurate and efficient address discharging, a bias voltage lower than that of the display data signal is applied to the X electrode lines X1 through X480.

According to such a typical address-display separation driving method, there are 480 Y driving devices to drive the Y electrode lines Y1 through Y480. For example, when driving a plasma display panel having 480 pairs of the X and Y electrode lines, a single X driving device and 480 Y driving devices are required. As many driving devices are required in proportion to the vertical resolution of a plasma display apparatus, the power consumption and manufacturing cost of the plasma display apparatus increase.

SUMMARY OF THE INVENTION

To solve the above and other problems, it is an object of the present invention to provide a method of driving a plasma display panel through which an address voltage applied to address electrode lines and a sustain voltage applied to sustain electrode lines can be reduced when the plasma display panel is driven by an address-display separation driving method and an AND logic driving method.

Additional objects and advantages of the invention will be set forth in part in the description which follows and, in part, will be obvious from the description, or may be learned by practice of the invention.

Accordingly, to achieve the above and other objects of the invention, a method of driving a plasma display panel according to an embodiment of the invention includes, for the plasma display panel having front and rear substrates disposed opposite each other, parallel X and Y electrode lines formed between the front and rear substrates, and address electrode lines having a direction perpendicular to a direction of the X and Y electrode lines to define discharge cells at intersections of the X and Y electrode lines and the address electrode lines, where the X electrode lines are combined in X groups, the Y electrode lines are combined in Y groups, adjacent pairs of the X and Y electrode lines belong to different pairs of the X and Y groups, the X electrode lines are commonly interconnected in units of the X groups, and the Y electrode lines are commonly interconnected in units of Y groups, the method includes a reset operation, a first scan operation, a first address operation, a repetition operation, and a sustain operation.

According to an aspect of the present invention, in the reset operation, wall charges formed in a previous sub-field are erased, in the first scan operation, a Y scan pulse of a first polarity is applied to the Y electrode lines of a first pair of the X and Y groups including a first pair of the X and Y electrode lines, and simultaneously, an X scan pulse of a second polarity opposite to the first polarity is applied to the X electrode lines thereof so that wall charges of the second polarity are formed around the Y electrodes on the first pair of the X and Y electrode lines.

According to another aspect of the present invention, in the first address operation, a display data signal corresponding to the first pair of the X and Y electrode lines is applied to all the address electrode lines, and simultaneously, a bias voltage of the first polarity is applied to the Y electrode lines of the first pair of the X and Y groups, and a bias voltage of the second polarity is applied to the X electrode lines thereof so that the wall charges that have been formed at discharge cells of the first pair of X and Y electrode lines are erased, which are not to be displayed and wall charges of the second polarity are additionally formed around the Y electrodes of discharge cells which are to be displayed on the first pair of X and Y electrode lines.

According to a further aspect of the present invention, in the repetition operation, the first scan operation and the address operation are performed on the sequential remaining pairs of X and Y electrode lines.

According to a still further aspect of the present invention, in the sustain operation, an operation of applying a sustain pulse of the second polarity to all the Y electrode lines and then applying a sustain pulse of the second polarity to all the X electrode lines is repeatedly performed for a time corresponding to the gray-scale of a current sub-field.

In a method of driving such a plasma display panel according to another embodiment of the present invention, wall charges of the second polarity are additionally formed around the Y electrodes of discharge cells which are displayed on the first pair of X and Y electrode lines in the first address operation, and the first address operation is sequentially performed on the remaining pairs of X and Y electrode lines in the repetition operation such that an address voltage applied to the address electrode lines and a sustain voltage applied to sustain electrode lines can be set to low levels.

BRIEF DESCRIPTION OF THE DRAWINGS

The above and other objects and advantages of the present invention will become more apparent and more readily appreciated by describing in detail preferred embodiments thereof with reference to the attached drawings in which

FIGS. 9A through 9C are enlarged voltage waveform diagrams illustrating the characteristic driving signals of the embodiment of the present invention among the driving signals of FIG. 8;

FIGS. 10A through 10C are diagrams illustrating the distribution of charges in a certain discharge cell of a plasma display panel at each time point of FIG. 9;

DETAILED DESCRIPTION OF THE PREFERRED EMBODIMENTS

Figure 1A:
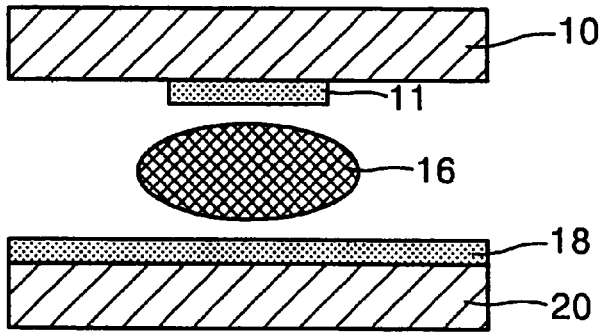
FIG. 1A (PRIOR ART)
FIG. 1A is a sectional view illustrating a conventional direct current (DC) type plasma display panel having a counter-discharge structure.
Figure 1B:
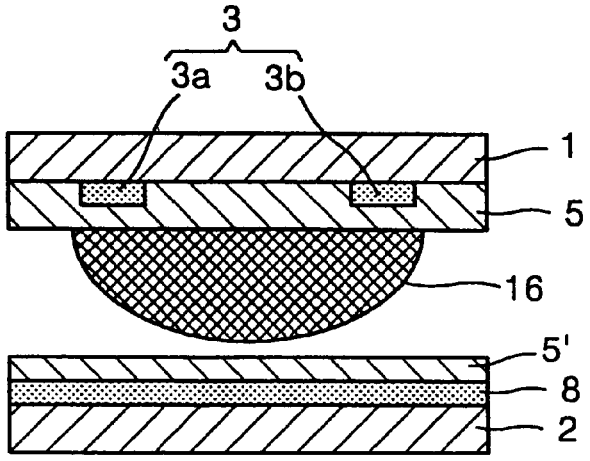
FIG. 1B (PRIOR ART)
FIG. 1B is a sectional view illustrating a conventional alternating current (AC) type plasma display panel having a surface-discharge structure.
Figure 2:
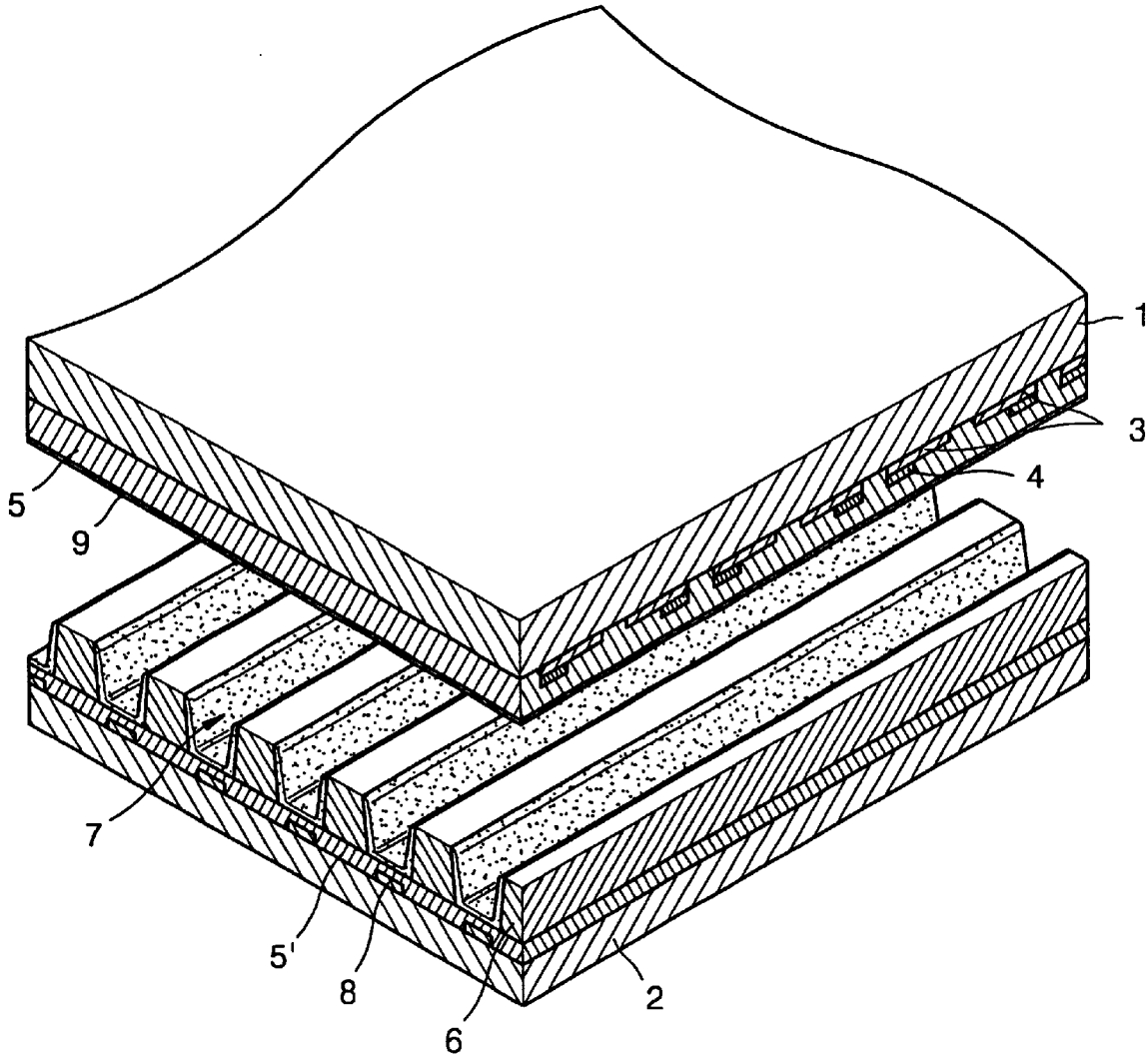
FIG. 2 (PRIOR ART)
FIG. 2 is a perspective view illustrating a conventional AC type triode surface-discharge plasma display panel.
Figure 3:
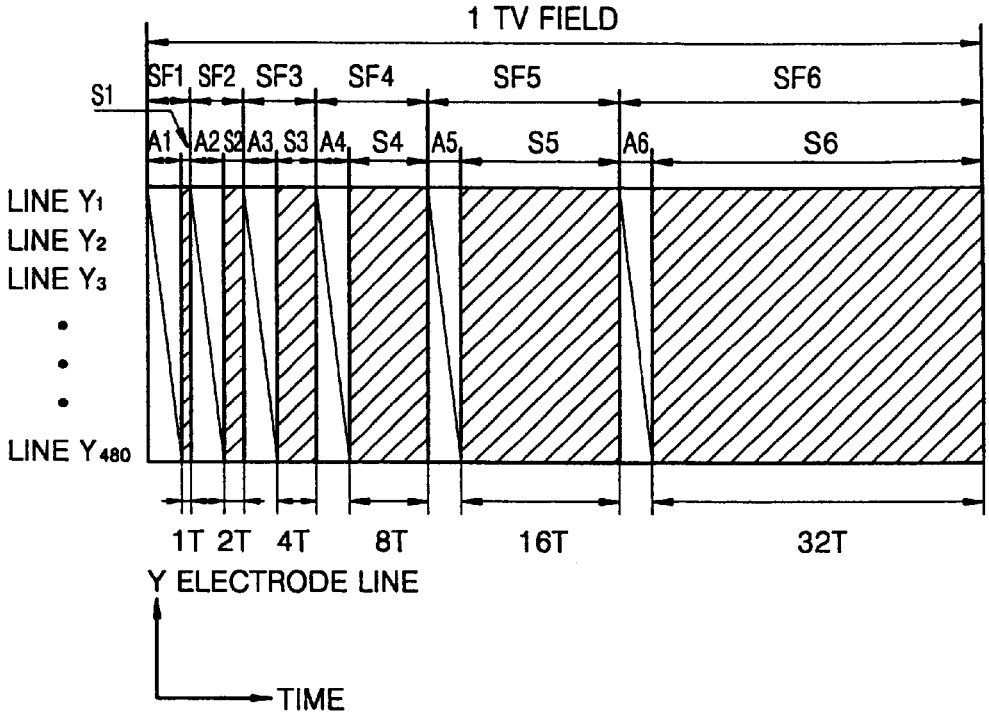
FIG. 3 (PRIOR ART)
FIG. 3 is a timing diagram illustrating a conventional address-display separation driving method for the AC type triode surface-discharge plasma display panel of FIG. 2.
Figure 4:
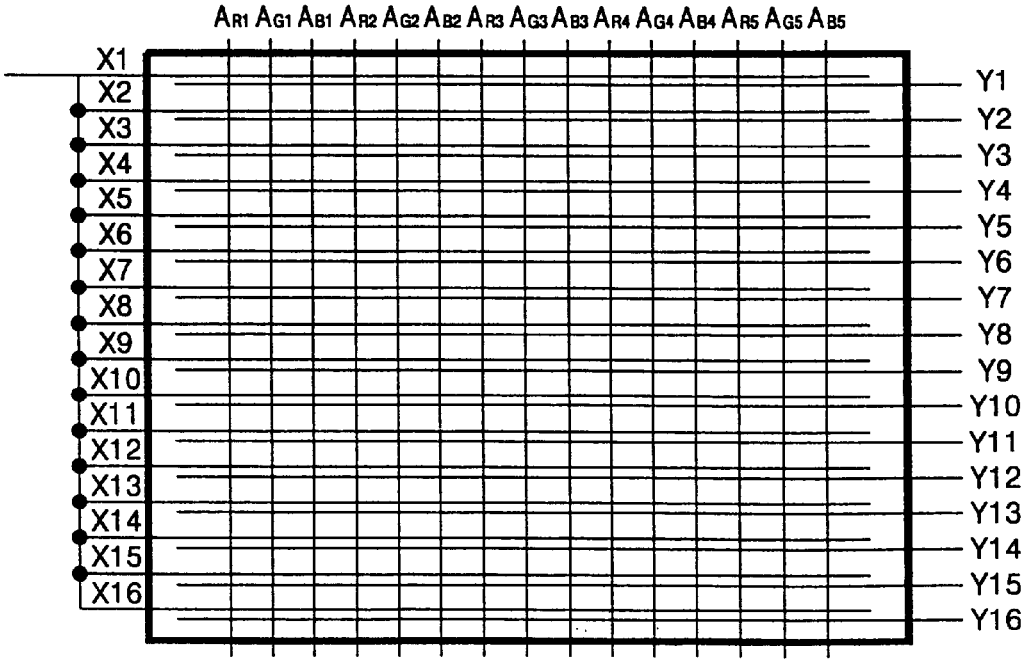
FIG. 4 (PRIOR ART)
FIG. 4 is a diagram illustrating the interconnections between electrode lines used to perform the driving method of FIG. 3 in the plasma display panel of FIG. 2.
Figures 5A, 5B, 5C, 5D, 5E:
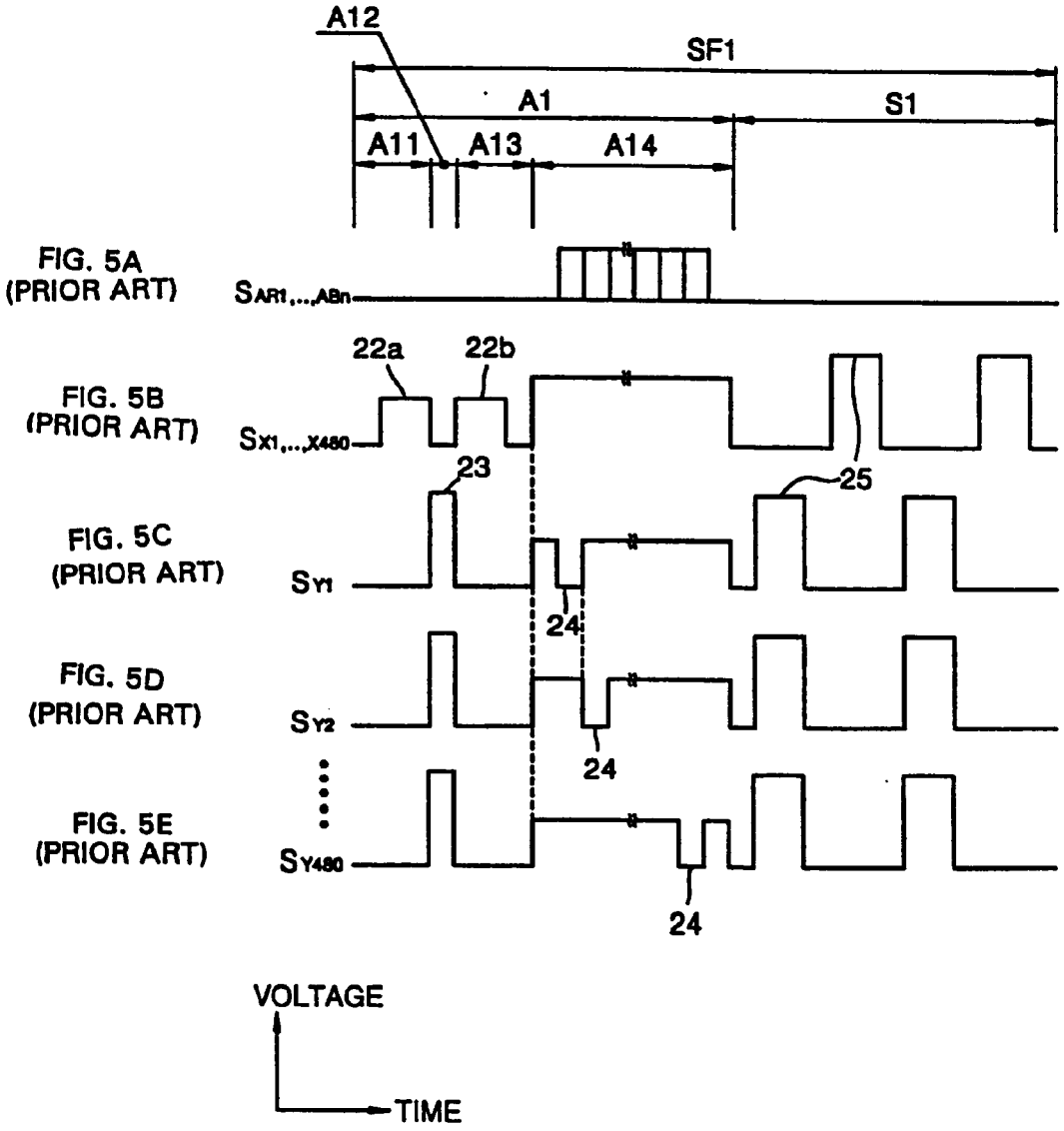
FIG. 5A (PRIOR ART)
FIG. 5B (PRIOR ART)
FIG. 5C (PRIOR ART)
FIG. 5D (PRIOR ART)
FIG. 5E (PRIOR ART)
FIGS. 5A through 5E are voltage waveform diagrams illustrating driving signals in a unit sub-field according to the address-display separation driving method of FIG. 3.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 6:
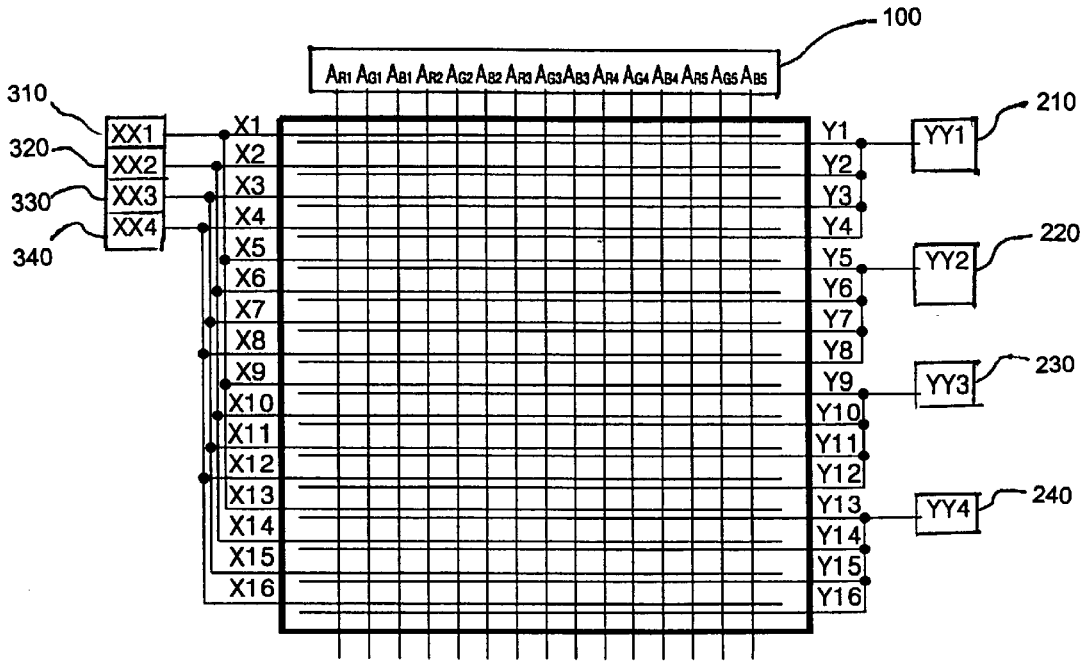
FIG. 6 is a diagram illustrating the interconnections of electrode lines of a triode surface-discharge plasma display panel according to an AND logic driving method.
Figures 7A, 7B, 7C, 7D, 7E, 7F, 7G, 7H, 7I:
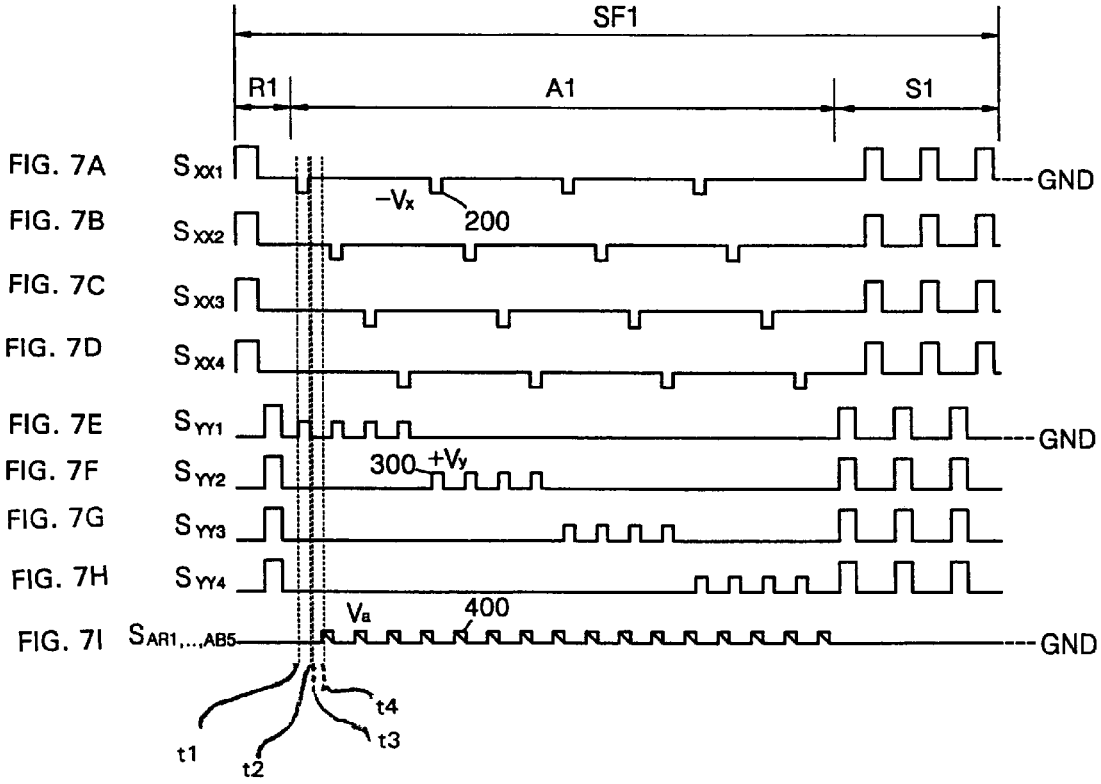
FIGS. 7A through 7I are voltage waveform diagrams illustrating driving signals in a unit sub-field which are used for driving a plasma display panel having the AND logic interconnection structure of FIG. 6 according to an address-display separation driving method and an AND logic driving method.
Figures 8A, 8B, 8C, 8D, 8E, 8F, 8G, 8H, 8I:
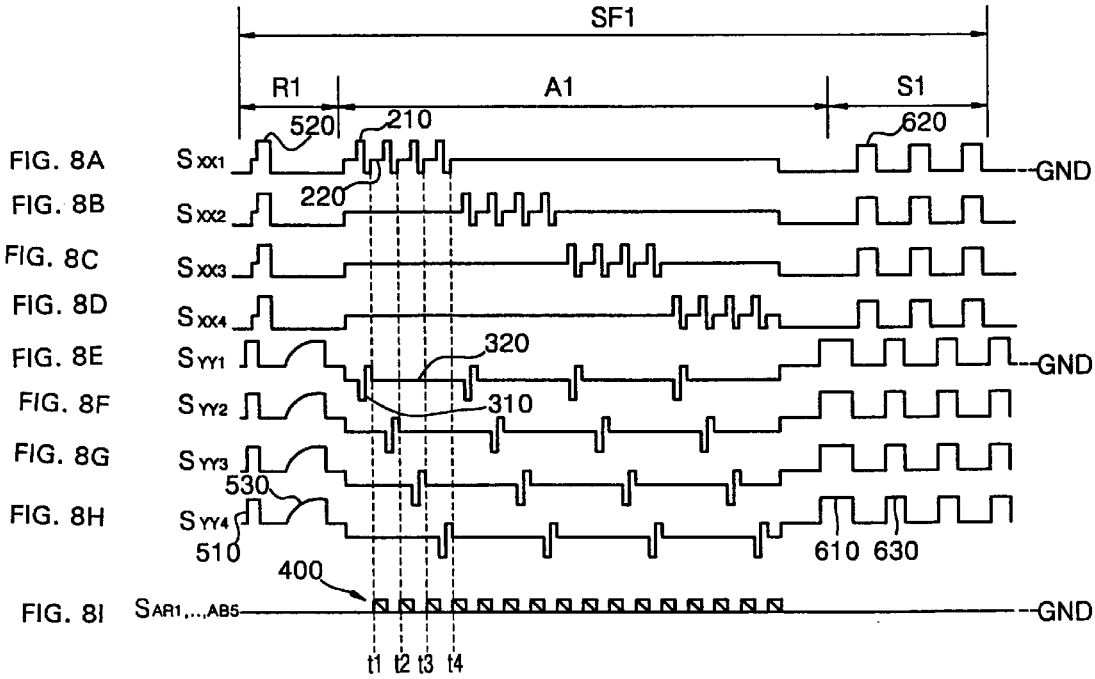
FIGS. 8A through 8I are voltage waveform diagrams illustrating driving signals in a unit sub-field which are used for driving a plasma display panel having the AND logic interconnection structure of FIG. 6 using an address-display separation driving method and an AND logic driving method according to an embodiment of the present invention.

An AND logic driving method as shown in FIGS. 6 and 7 has been developed. FIG. 6 shows the interconnections of electrode lines of a triode surface-discharge plasma display panel according to an AND logic driving method. Referring to FIG. 6, X electrode lines X1 through X16 are combined into four X groups XX1 through XX4, and Y electrode lines Y1 through Y16 are combined into four Y groups YY1 through YY4. Here, pairs of adjacent X and Y electrode lines (i.e., X1Y1, X2Y2, . . . , X16Y16), belong to different pairs of X and Y groups (i.e., XX1YY1, XX1YY2, XX1YY3 . . . XX4,YY4). The X electrode lines are commonly interconnected and driven in units of X groups by corresponding X drivers 310, 320, 330, and 340, and the Y electrode lines are commonly interconnected and driven in units of Y groups by corresponding Y drivers 210, 220, 230, and 240. The address electrode lines $A_{R1}$ through $A_{B5}$ are driven by an address driver 100. According to a driving method for such an interconnection structure for a plasma display panel having 480 pairs of X and Y electrode lines, 120 X drivers, and 120 Y drivers are required. As the number of X. and Y drivers used in a plasma display apparatus decreases, the power consumption and the manufacturing cost of the plasma display apparatus decrease.

FIGS. 7A through 7I show driving signals in a unit sub-field which are used to drive a plasma display panel having the AND logic interconnection structure of FIG. 6 according to an address-display separation driving method and an AND logic driving method. In FIGS. 7A through 7I, reference characters $S_{XX1}$ through $S_{XX4}$ denote driving signals for respective first through fourth X groups (XX1 through XX4 of FIG. 6). Reference characters $S_{YY1}$ through $S_{YY4}$ denote driving signals for respective first through fourth Y groups (YY1 through YY4 of FIG. 6). A reference character $S_{AR1,\ldots AB5}$ denotes a data signal applied to all the address electrode lines ($A_{R1}$ through $A_{B5}$ of FIG. 6). A reference character SF1 denotes a unit sub-field, a reference character R1 denotes a reset period, a reference character A1 denotes an address period, and a reference character S1 denotes a sustain period. While not shown, it is understood that drivers 100, 210, 220, 230, 240, 310, 320, 330, and 340 for the X, Y, and address electrode lines can be coordinated using a system controller such as a logic circuit.

Referring to FIGS. 7A through 7I, during the reset period R1, a positive polarity pulse having a relatively high voltage and a relatively long width is applied to all the X groups XX1 through XX4 so that wall charges of negative polarity are concentrated around all the X electrodes, and wall charges of positive polarity are concentrated around all the Y electrodes. Thereafter, an erase pulse is applied to all the Y groups YY1 through YY4 so that the wall charges concentrated on discharge cells are erased.

During a first scan period between t1 and t2 in the scan-address period A1, an X scan pulse 200 of a negative voltage −Vx is applied to the X electrode lines of groups XX1 and YY1 including a first pair X1-Y1 of the X and Y electrode lines of FIG. 6, and simultaneously, a Y scan pulse 300 of a positive voltage +Vy is applied to the Y electrode lines thereof. As a result, wall charges are formed at discharge cells defined by the first pair X1-Y1 of X and Y electrode lines.

During a first address period between t3 and t4, a display data signal corresponding to the first pair X1-Y1 of X and Y electrode lines is applied to all the address electrode lines $A_{R1}$ through $A_{B5}$ in a state where a potential is not applied to all the pairs of X and Y groups (i.e., where a ground potential GND is applied). Here, a pulse of a ground potential GND is applied to address electrode lines corresponding to discharge cells to be displayed, and a data pulse 400 of a positive address voltage Va is applied to address electrode lines corresponding to discharge cells which are not displayed. Accordingly, wall charges are erased from the discharge cells which are not displayed among discharge cells defined by the first pair X1-Y1 of X and Y electrode lines.

The first scan period between t1 and t2 and the address period between t3 and t4 are sequentially applied to the remaining pairs of X and Y electrode lines.

During the sustain period S1, a sustain pulse of a positive polarity is applied to all the alternating X and Y electrode lines during a time corresponding to the gray-scale of a current sub-field so that sustain discharging is performed at the discharge cells, where wall charges were formed and were not erased during the scan-address period A1.

According to the AND logic driving method applied to an address-display separation driving method, the voltages −Vx and +Vy of the scan pulses 200 and 300 applied during the scan period (for example, the period between t1 and t2) in the scan-address period A1 are low because of the high probability that the voltages −Vx and +Vy of the scan pulses 200 and 300 influence adjacent electrode lines in the common interconnection structure of the AND logic driving method. Therefore, the driving method shown in FIGS. 7A through 7I has the address voltage Va of the data pulse 400 and a sustain voltage, which is applied during the sustain period S1 set to be relatively high.

FIGS. 8A through 8I show driving signals in a unit sub-field which are used for driving a plasma display panel having the AND logic interconnection structure of FIG. 6 using an address-display separation driving method and an AND logic driving method according to an embodiment of the present invention. FIGS. 9A through 9C show the enlarged characteristic driving signals of the present invention among the driving signals of FIG. 8. FIGS. 10A through 10C show the distribution of charges in a certain discharge cell of a plasma display panel at each time point of FIGS. 9A through 9C. In FIGS. 7A through 9C, the same reference numerals denote the same functional members.

Referring to FIGS. 8A through 10C, during a reset period R1, a positive polarity pulse 510 is applied to all Y groups (YY1 through YY4 of FIG. 6), and then a positive polarity pulse 520 is applied to all X groups (XX1 through XX4 of FIG. 6), so that wall charges of a positive polarity are concentrated around all Y electrodes, and wall charges of negative polarity are concentrated around all X electrodes. Thereafter, a pulse of a waveform whose voltage gradually increases and then drops is applied to all the Y groups YY1 through YY4 so that the wall charges concentrated or all discharge cells are erased. However, it is understood that the pulse of a waveform whose voltage gradually increases and then drops is not required in all circumstances.

During a first scan period before a time point t1*a* in a scan-address period A1 as shown in FIGS. 9A to 9C, after a positive bias voltage 220 is applied to the X electrodes and a negative bias voltage 320 is applied to the Y electrodes, a Y scan pulse 310 of a negative voltage (for example, −140 V) is applied to the Y electrode lines of the first pair (XX1-YY1 of FIG. 6) of X and Y groups that includes a first pair (X1-Y1 of FIG. 6) of X and Y electrode lines. Simultaneously, an X scan pulse 210 of a positive voltage (for example, +140 V) is applied to the X electrode lines of the first pair of X and Y groups. As a result, the wall charges of a negative polarity are formed around the X electrodes of all discharge cells defined by the first pair X1-Y1 of X and Y electrode lines, and wall charges of a positive polarity are formed around the Y electrodes thereof. Here, since the power levels of the X and Y scan pulses should be set to be low due to the characteristics of AND logic driving, a small amount of wall charges are formed (see FIG. 10A).

During a first address period between t1 and t1*b* as shown in FIGS. 9A to 9C, a display data signal $S_{AR1, \ldots, AB5}$ corresponding to the first pair X1-Y1 of X and Y electrode lines is applied to all address electrode lines ($A_{R1}$ through $A_{B5}$ of FIG. 6), and simultaneously, a negative bias voltage 320 (for example, −30 V) is applied to the Y electrode lines of the pair XX1-YY1 of X and Y groups including the first pair X1-Y1 of X and Y electrode lines, and a positive bias voltage 220(for example, +30 V) is applied to the X electrode lines thereof. Here, a pulse 400 of an address voltage (i.e., +80 V) is applied to the address electrode lines corresponding to discharge cells which are not to be displayed among the discharge cells defined by the first pair X1-Y1 of X and Y electrode lines. On the other hand, a ground voltage of 0 V is applied to the address electrode lines corresponding to discharge cells which are to be displayed. As a result, the wall charges, which were formed during the first scan period right before the time point t1*a* in the scan-address period A1, are erased by the erase address pulse 400 (see FIG. 10C). Simultaneously, the wall charges of a positive polarity are additionally formed around the Y electrodes of the discharge cells which are displayed among the discharge cells defined by the first pair X1-Y1 of X and Y electrode lines, and wall charges of a negative polarity are additionally formed around the X electrodes thereof (see FIG. 10B). In other words, a positive wall voltage around the Y electrodes of the discharge cells which are displayed among the discharge cells defined by the first pair X1-Y1 of X and Y electrode lines increases, and a negative wall voltage around the X electrodes thereof also increases. Therefore, an address voltage applied to the address electrode lines $A_{R1}$ through $A_{B5}$ and a sustain voltage applied to the X groups XX1 through XX4 and the Y groups YY1 through YY4 of sustain electrode lines can be set to lower levels.

Such a first scan and address period right before the time point t1*b* in the scan-address period is sequentially applied to the remaining pairs of X and Y electrode lines.

During a sustain period S1, sustain pulses 610, 620 and 630 are alternately applied to the X groups XX1 through XX4 of all X electrode lines and to the Y groups YY1 through YY4 of all Y electrode lines for a time corresponding to the gray-scale of a current sub-field. The sustain pulse 610 is wider (i.e., applied for longer) than the sustain pulses 620 and 630. As a result, sustain discharging is performed at the discharge cells where wall charges are formed and are not erased during the scan-address period A1.

It is understood that the sustain pulse 610 need not be wider than the sustain pulses 620 and 630 in all circumstances so long as the energy of the sustain pulse 610 is greater than that of the sustain pulses 620 and 630. It is further understood that the sustain pulses 620 and 630 can have different widths in other circumstances.

Figure 11:
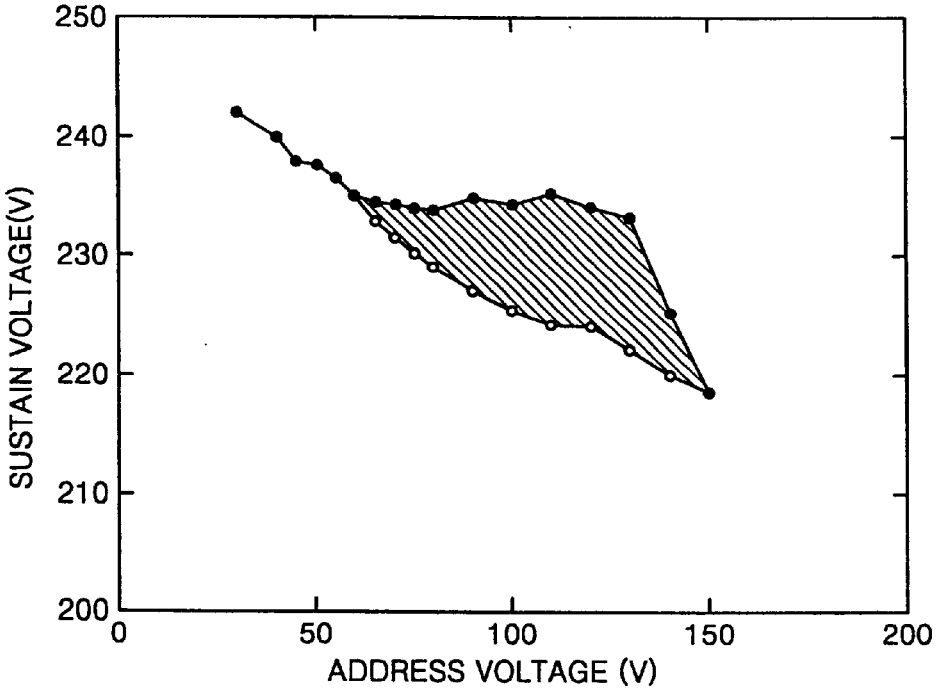
FIG. 11 is a graph illustrating the operating margin of a sustain voltage with respect to address voltage in the driving method of FIG. 7.
Figure 12:
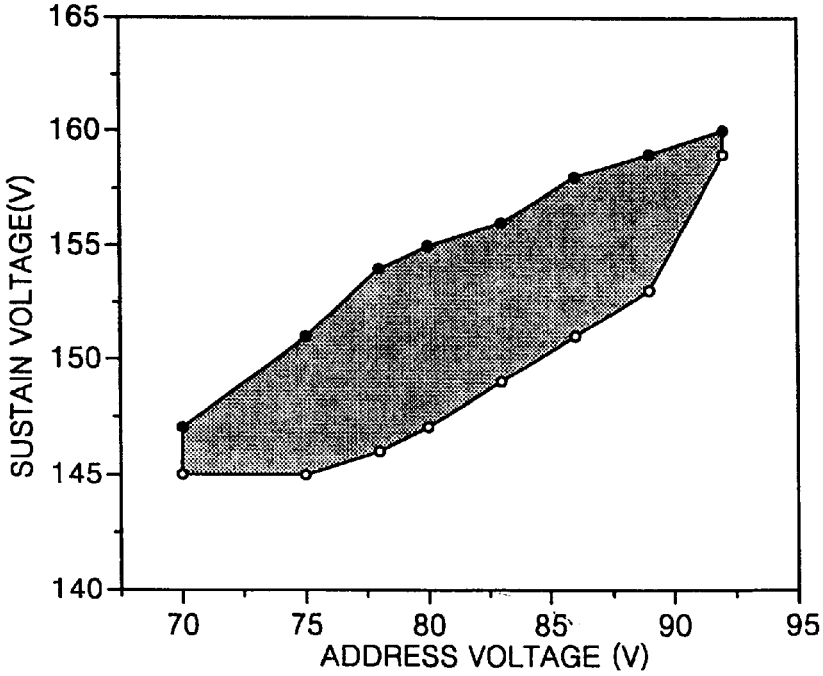
FIG. 12 is a graph illustrating the operating margin of a sustain voltage with respect to address voltage in the driving method of FIG. 8 according to an embodiment of the present invention.

FIG. 11 illustrates the operating margin of a sustain voltage with respect to address voltage in the driving method of FIG. 7. FIG. 12 illustrates the operating margin of sustain voltage with respect to address voltage in the driving method of FIG. 8 according to an embodiment of the present invention. Referring to FIGS. 11 and 12, it can be seen that the operating margin of sustain voltage with respect to address voltage in a driving method according to the present invention exists in a lower voltage area compared to a conventional driving method.

It is understood that the polarities of the scan and bias pulses and/or the display data signal could be reversed in other embodiments of the present invention.

As described above, in a method of driving a plasma display panel according to the present invention, wall charges are additionally formed at discharge cells which are displayed among the discharge cells defined by a certain pair of X and Y electrode lines during an address period. Therefore, an address voltage applied to address electrode lines and a sustain voltage applied to sustain electrode lines can be set to low levels.

The present invention is not restricted to the above particular embodiments, but it will be apparent to one of ordinary skill in the art that modifications may be made without departing from the spirit and scope of the invention and the equivalents thereof.

What is claimed is:

1. A method of driving a plasma display panel having front and rear substrates opposite each other, parallel X and Y electrode lines formed on the front substrate between the front and rear substrates, and address electrode lines formed on the rear substrate in a direction perpendicular to a direction of the X and Y electrode lines to define discharge cells at intersections of the X and Y electrode lines and the address electrode lines, the X electrode lines being combined into X groups, the Y electrode lines being combined into Y groups such that adjacent pairs of the X and Y electrode lines belong to different pairs of the X and Y groups, the X electrode lines being commonly interconnected in units of the X groups, the Y electrode lines being commonly interconnected in units of the Y groups, the method comprising:

erasing wall charges formed in the discharge cells of a previous sub-field;

simultaneously applying a Y scan pulse of a first polarity to the Y electrode lines of a first pair of the X and Y groups which includes a first pair of the X and Y electrode lines, and an X scan pulse of a second polarity opposite to the first polarity to the X electrode lines of the first pair of X and Y groups so that wall charges of the second polarity are formed around the Y electrodes of the first pair of the X and Y electrode lines;

simultaneously applying a display data signal corresponding to the first pair of the X and Y electrode lines to the address electrode lines, a bias voltage of the first polarity to the Y electrode lines of the first pair of the X and Y groups, and a bias voltage of the second polarity to the X electrode lines of the first pair of the X and Y groups, wherein the wall charges that have been formed at ones of the discharge cells which are not to be displayed are erased, and the wall charges of the second polarity are additionally formed around the Y electrodes of ones of the discharge cells which are to be displayed by the first pair of the X and Y electrode lines;

repeatedly performing said applying the X and Y scan pulses and said simultaneously applying the display data signal and the bias pulses on the sequential remaining pairs of the X and Y electrode lines; and repeatedly applying a sustain pulse of the second polarity to all the Y electrode lines, and then applying a sustain pulse of the second polarity to all the X electrode lines for a time corresponding to a gray-scale of a current sub-field.

2. The method of claim 1, wherein said erasing the wall charges comprises:

applying a first pulse of the first polarity to the Y electrode lines of the X and Y groups;

applying a second pulse of the first polarity to the X electrode lines of the X and Y groups; and applying a third pulse of the first polarity to the Y electrode lines of the X and Y groups.

3. The method of claim 2, wherein the second pulse is applied after the first pulse, the third pulse is applied after the second pulse, and the third pulse comprises a voltage that is gradually increased and then rapidly dropped.

4. The method of claim 1, wherein said simultaneously applying the display data signal and the bias voltages further comprises applying the bias voltages of the first polarity to the Y groups, and the voltages pulses of the second polarity to the X groups.

5. The method of claim 4, wherein said applying the scan pulse comprises applying the X and Y scan pulses to the first pair of the X and Y groups during said applying the bias voltages to the X and Y groups.

6. The method of claim 5, wherein said repeatedly performing said applying the X and Y scan pulses and said simultaneously applying the display data signal and the bias voltages comprise simultaneously applying the X scan pulses to a first X group of the first pair of the X and Y groups, and applying the Y scan pulses to the remaining Y groups during said applying the bias voltages to all the X and Y groups so as to form the wall charges in remaining pairs of the X and Y electrodes lines which include the X electrode lines of the first X group.

7. The method of claim 6, wherein said repeatedly performing said applying the X and Y scan pulses and said simultaneously applying the display data signal and the bias voltages further comprise simultaneously applying the X scan pulses to a second X group of a second pair of the X and Y groups, and applying the Y scan pulses to the remaining Y groups during said applying the bias voltages to all the X and Y groups so as to form the wall charges in remaining pairs of the X and Y electrodes lines which include the X electrode lines of the second X group.

8. The method of claim 1, wherein the bias voltages are applied during an address period after said erasing the wall charges, and prior to said repeatedly applying the sustain pulses.

9. The method of claim 1, wherein an operating margin of a sustain voltage of the sustain pulse versus an address voltage of the display data signal is such that an increase in the sustain voltage results in an increase in the address voltage.

10. The method of claim 1, wherein an operating margin of a sustain voltage of the sustain pulse versus an address voltage of the display data signal is such that the sustain voltage is at or below 160 volts, and the address voltage is at or below 90 volts.

11. The method of claim 1, further comprising repeating for sub-fields of a current unit television field said erasing the wall charges formed in the previous sub-field, said simultaneously applying the X and Y scan pulses, said simultaneously applying the display data signal and the bias voltages, said repeatedly performing said applying the scan pulse and said simultaneously applying the display data signal and the bias voltages on the sequential remaining pairs of the X and Y electrode lines, and said repeatedly applying the sustain pulses to all the X and Y electrode lines for the current sub-field.

12. A method of driving a plasma display panel having front and rear substrates opposite each other, parallel X and Y electrode lines formed on the front substrate between the front and rear substrates, and address electrode lines formed on the rear substrate in a direction not parallel to a direction of the X and Y electrode lines to define discharge cells at intersections of the X and Y electrode lines and the address electrode lines, the X electrode lines being combined into X groups and the Y electrode lines being combined Into Y groups such that adjacent pairs of the X and Y electrode lines belong to different pairs of the X and Y groups, the X electrode lines being commonly interconnected in units of the X groups, the Y electrode lines being commonly interconnected in units of Y groups, the method comprising:

erasing wall charges previously formed in the discharge cells;

applying a Y scan pulse of a first polarity to the Y electrode lines of a first of the Y groups while applying an X scan pulse of a second polarity opposite to the first polarity to the X electrode lines of a first of the X groups so that the wall charges of the second polarity are formed around the Y electrode lines of a first pair of the X and Y electrode lines common to the first X and Y groups;

applying a bias voltage of the first polarity to the Y electrode lines of the first Y group while applying a bias voltage of the second polarity to the X electrode lines of the first X group;

applying a display data signal corresponding to the first pair of the X and Y electrode lines to the address electrode lines to selectively erase the wall charges from ones of the discharge cells of the first pair of X and Y electrodes that are not to be displayed while the bias voltages are applied; and applying a sustain pulse of the second polarity to the Y electrode lines and then applying a sustain pulse of the second polarity to the X electrode lines.

13. The method of claim 12, wherein said erasing the wall charges comprises:

applying a first pulse of the first polarity to the Y electrode lines;

applying a second pulse of the first polarity to the X electrode lines; and applying a third pulse of the first polarity to the Y electrode lines.

14. The method of claim 13, wherein the second pulse is applied after the first pulse, the third pulse is applied after the second pulse, and the third pulse comprises a voltage that is gradually increased and then rapidly dropped.

15. The method of claim 12, wherein said applying the bias voltages further comprises applying the bias voltages of the first polarity to the Y groups in addition to the first Y group, and the bias voltages of the second polarity to the X groups in addition to the first X group.

16. The method of claim 15, wherein said applying the X and Y scan pulses comprises applying the X and Y scan pulses to the first X and Y groups during said applying the bias voltages to the X and Y groups.

17. The method of claim 16, further comprising:

applying the X scan pulses to the first X group while applying the Y scan pulses to the remaining Y groups other than the first Y group;

applying the bias voltages to the X and Y groups so as to form the wall charges in remaining pairs of the X and Y electrodes lines which include the X electrode lines of the first X group; and applying the display data signal corresponding to the remaining pairs of the X and Y electrodes to selectively erase the wall charges from ones of the discharge cells which are not to be displayed.

18. The method of claim 17, further comprising:

applying the X scan pulses to a second X group while applying the Y scan pulses to the Y groups;

applying the bias voltages to the X and Y groups so as to form the wall charges in remaining pairs of the X and Y electrodes lines which include the X electrode lines of the second X group; and applying the display data signal corresponding to the further pairs of the X and Y electrodes to selectively erase the wall charges from ones of the discharge cells which are not to be displayed.

19. The method of claim 12, wherein the X and Y bias voltages are applied during an address period after said erasing the wall charges and prior to said applying the sustain pulses.

20. The method of claim 12, wherein an operating margin of a sustain voltage of the sustain pulse versus an address voltage of the display data signal is such that an increase in the sustain voltage results in an increase in the address voltage.

21. The method of claim 12, wherein an operating margin of a sustain voltage of the sustain pulse versus an address voltage of the display data signal is such that the sustain voltage is at or below 160 volts, and the address voltage is at or below 90 volts.

22. The method of claim 12, wherein said applying the display data signal comprises applying the display data signal so that the wall charges that have been formed at the ones of the discharge cells which are not to be displayed are erased, and the wall charges of the second polarity are additionally formed around the Y electrodes of the ones of the discharge cells which are to be displayed.

23. A plasma display apparatus, comprising:

front and rear substrates disposed opposite each other to form a discharge space;

parallel X and Y electrode lines disposed on said front substrate between said front and rear substrates, said X electrode lines being combined into X groups, and said Y electrode lines being combined into Y groups such that adjacent pairs of said X and Y electrode lines belong to different pairs of the X and Y groups;

address electrode lines formed on said rear substrate in a direction not parallel to a direction of said X and Y electrode lines to define discharge cells at intersections of said X and Y electrode lines and said address electrode lines within the discharge space;

X drivers to drive the corresponding X groups;

Y drivers to drive the corresponding Y groups;

an address driver to drive said address electrode lines; and a gas sealed in the discharge space so as to form a plasma, wherein said X and Y drivers drive said X and Y groups to erase wall charges previously formed in the discharge cells, a first one of said Y drivers drives a first one of the Y groups to apply a Y scan pulse of a first polarity to said Y electrode lines of the first Y group while a first one of said X drivers drives a first one of the X groups to apply an X scan pulse of a second polarity opposite to the first polarity to said X electrode lines of the first X group so that wall charges of the second polarity are formed around said Y electrode lines of a first pair of said X and Y electrode lines common to the first X and Y groups, said first Y driver drives the first Y group to apply a bias voltage of the first polarity to said Y electrode lines of the first Y group while said first X driver drives the first X group to apply a bias voltage of the second polarity to said X electrode lines of the first X group, said address driver drives said address electrode lines to apply a display data signal corresponding to the first pair of said X and Y electrode lines to selectively erase the wall charges that have been formed at ones of the discharge cells which are not to be displayed, and said X and Y drivers drive the X and Y groups to apply sustain pulses of the second polarity to said X and Y electrode lines.

24. A method of driving a plasma display panel having front and rear substrates opposite each other, parallel X and Y electrode lines formed on the front substrate between the front and rear substrates, and address electrode lines formed on the rear substrate in a direction not parallel to a direction of the X and Y electrode lines to define discharge cells at intersections of the X and Y electrode lines and the address electrode lines, the X electrode lines being combined into X groups and the Y electrode lines being combined into Y groups such that adjacent pairs of the X and Y electrode lines belong to different pairs of the X and Y groups, the X electrode lines being commonly interconnected in units of the X groups, the Y electrode lines being commonly interconnected in units of Y groups, the method comprising:

erasing wall charges previously formed in the discharge cells;

applying scan pulses to the X and Y electrode lines of a first of the X and Y groups so that the wall charges are formed at a first pair of the X and Y electrode lines common to the first X and Y groups;

applying bias voltages to the X and Y electrode lines of the first X and Y groups while applying a display data signal corresponding to the first pair of the X and Y electrode lines to the address electrode lines to erase the wall charges from ones of the discharge cells of the first pair of X and Y electrodes that are not to be displayed and to additionally form the wall charges in the discharge cells of the first pair of X and Y electrodes to be displayed; and applying sustain pulses to the X and Y electrode lines to perform the display of the discharge cells to be displayed.

* * * * *